US007520012B2

(12) United States Patent
Robins

(10) Patent No.: US 7,520,012 B2
(45) Date of Patent: Apr. 21, 2009

(54) MATTRESS

(75) Inventor: John A. Robins, Houston, TX (US)

(73) Assignees: Continental Silverline Products, L.P. General Partner; Continental Silverline Products Management, LLC

( * ) Notice: Subject to any disclaimer, the term of this patent is extended or adjusted under 35 U.S.C. 154(b) by 278 days.

(21) Appl. No.: 11/370,694

(22) Filed: Mar. 8, 2006

(65) Prior Publication Data

US 2006/0288492 A1 Dec. 28, 2006

Related U.S. Application Data

(60) Provisional application No. 60/659,614, filed on Mar. 8, 2005.

(51) Int. Cl.
*A47C 27/15* (2006.01)

(52) U.S. Cl. ..... 5/740; 5/724; 5/727; 5/736

(58) Field of Classification Search ..... 5/724, 5/736, 740, 727
See application file for complete search history.

(56) References Cited

U.S. PATENT DOCUMENTS

| | | | | |
|---|---|---|---|---|
| 4,928,337 | A * | 5/1990 | Chauncey | 5/722 |
| 5,317,768 | A * | 6/1994 | Klancnik | 5/736 |
| 5,669,094 | A * | 9/1997 | Swanson | 5/740 |
| 6,541,094 | B1 * | 4/2003 | Landvik et al. | 428/71 |
| 6,578,220 | B1 * | 6/2003 | Smith | 5/740 |
| 6,601,253 | B1 * | 8/2003 | Tarquinio | 5/739 |
| 6,782,575 | B1 * | 8/2004 | Robinson | 5/740 |
| 7,334,280 | B1 * | 2/2008 | Swartzburg | 5/724 |

* cited by examiner

*Primary Examiner*—Michael Trettel
(74) *Attorney, Agent, or Firm*—Fulbright & Jaworski L.L.P.

(57) ABSTRACT

A mattress.

28 Claims, 8 Drawing Sheets

MATTRESS

CROSS REFERENCE TO RELATED APPLICATIONS

The present application claims the benefit of the filing date of U.S. provisional patent application Ser. No. 60/659,614, filed on Mar. 8, 2005, the disclosure of which is incorporated herein by reference.

BACKGROUND

The disclosures herein relate generally to mattresses, and in particular to mattresses incorporating visco elastic materials.

SUMMARY

According to one aspect of the present disclosure, a mattress is provided comprising a layer of urethane foam, a layer of visco elastic foam, and an intermediate layer for enhancing humidity transport positioned between the layer of urethane foam and the layer of visco elastic foam.

According to another aspect of the present disclosure, a method for manufacturing a mattress is provided comprising providing a layer of urethane foam having a urethane foam top surface, coupling an intermediate layer for enhancing humidity transport to the urethane foam top surface, the intermediate layer including an intermediate layer top surface, and coupling a layer of visco elastic foam including a visco elastic foam top surface to the intermediate layer top surface.

According to another aspect of the present disclosure, a mattress is provided comprising a top layer of visco elastic foam comprising a substantially planar top surface, a thickness of approximately 3.5 inches, and a density of approximately 5 lbs/ft$^3$, a bottom layer of urethane foam comprising a thickness of approximately 4.5 inches and a density of approximately 1.65 lbs/ft$^3$, and a polyester fiber intermediate layer positioned between the top layer of visco elastic foam and the bottom layer of urethane foam.

According to another aspect of the present disclosure, a mattress is provided comprising a top layer of visco elastic foam comprising a ventilated non-planar top surface, a thickness of approximately 4 inches, and a density of approximately 5 lbs/ft$^3$, a bottom layer of urethane foam comprising a thickness of approximately 6 inches and a density of approximately 1.65 lbs/ft$^3$, and a polyester fiber intermediate layer positioned between the top layer of visco elastic foam and the bottom layer of urethane foam.

According to another aspect of the present disclosure, a mattress is provided comprising a top layer of talalay latex natural foam comprising a thickness of approximately 1 inch and a density of approximately 2.5 lbs/ft$^3$, an intermediate layer of visco elastic foam comprising a ventilated non-planar top surface, a thickness of approximately 4 inches, and a density of approximately 5 lbs/ft$^3$, a bottom layer of urethane foam comprising a thickness of approximately 6 inches and a density of approximately 1.65 lbs/ft$^3$, and a polyester fiber intermediate layer positioned between the intermediate layer of visco elastic foam and the bottom layer of urethane foam.

According to another aspect of the present disclosure, a mattress is provided comprising a layer of urethane foam, a layer of visco elastic foam, and means for enhancing the respiration and humidity transport capacity of the mattress positioned between the layer of urethane foam and the layer of visco elastic foam.

DETAILED DESCRIPTION

Figure 1:
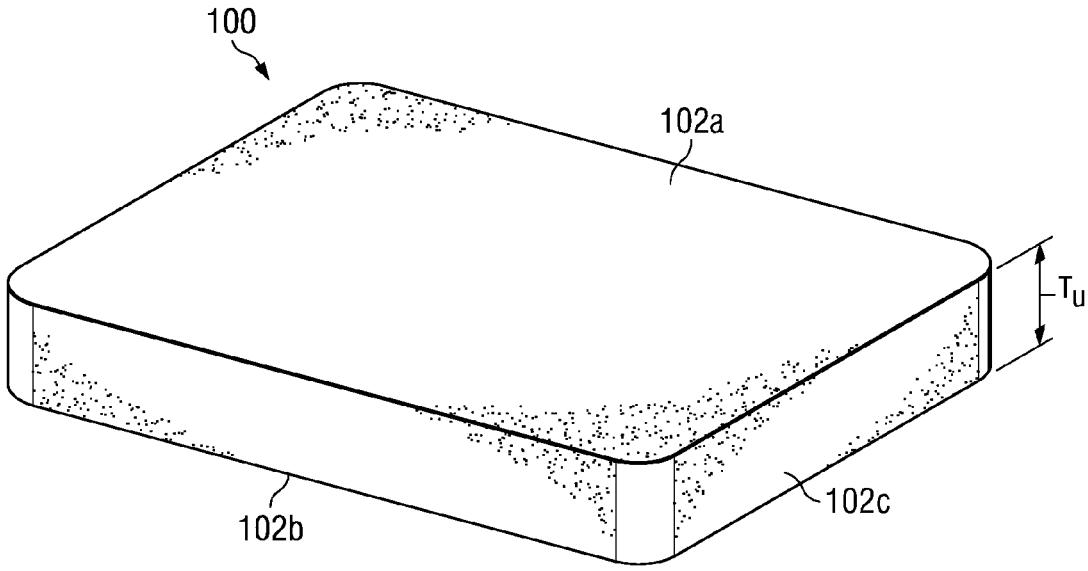
FIG. 1 is a perspective view illustrating an exemplary embodiment of a layer of urethane foam.

Referring now to FIG. 1, a layer of urethane foam 100 is illustrated. Urethane foam 100 includes a urethane foam top surface 102*a*, a urethane foam bottom surface 102*b* located opposite the urethane foam top surface 102*a*, and a urethane foam side surface 102*c* extending between the urethane foam top surface 102*a* and the urethane foam bottom surface 102*b* and about the perimeter of the urethane foam 100. Urethane foam 100 has a thickness $T_U$ which is measured between the urethane foam top surface 102*a* and the urethane foam bottom surface 102*b*. In an exemplary embodiment, the thickness $T_U$ of the urethane foam 100 is approximately 4.5 inches. In an exemplary embodiment, the thickness $T_U$ of the urethane foam 100 is approximately 6 inches. In an exemplary embodiment, the urethane foam 100 has a density of approximately 1.65 lbs/ft$^3$. In an exemplary embodiment, the urethane foam 100 has a compression range of approximately 30 to 35 pounds.

Figure 2:
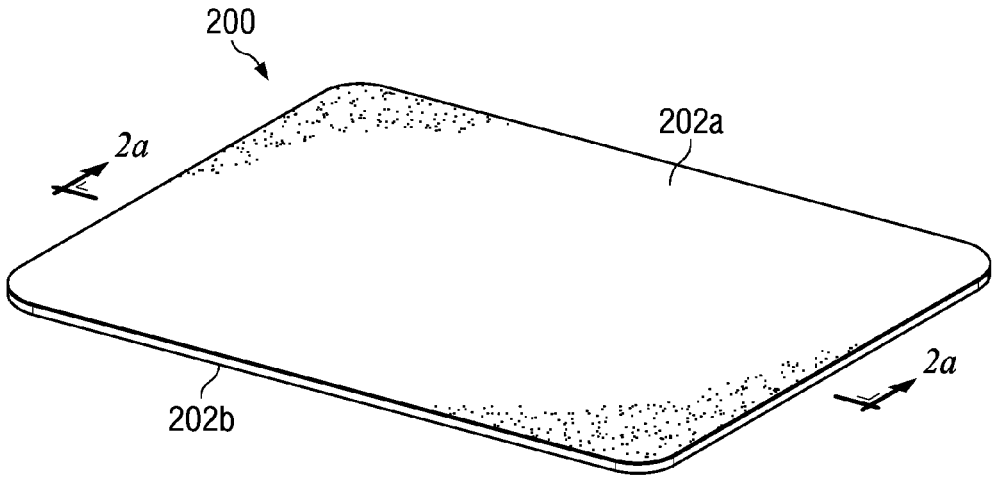
FIG. 2 is a perspective view illustrating an exemplary embodiment of an intermediate layer used with the layer of urethane foam of FIG. 1.
Figure 2A:
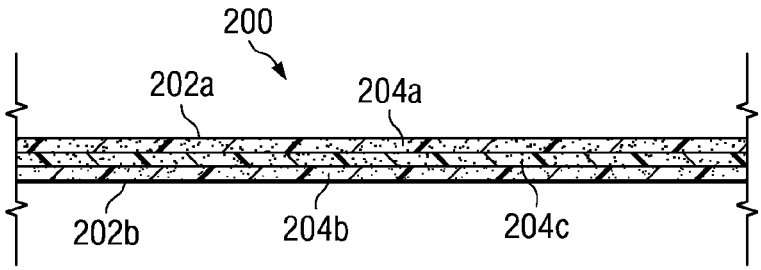
FIG. 2*a* is a cross sectional view illustrating an exemplary embodiment of the intermediate layer of FIG. 2.

Referring now to FIG. 2, an intermediate layer 200 is illustrated. Intermediate layer 200 includes an intermediate layer top surface 202*a* and an intermediate layer bottom surface 202*b* located opposite the intermediate layer top surface 202*a*. In an exemplary embodiment, the intermediate layer 200 includes layer of approximately 1.1 ounce low melt polyester fiber. In an exemplary embodiment, illustrated in FIG. 2*a*, the intermediate layer 200 includes a top layer 204*a* including top intermediate layer top surface 202*a*, a bottom layer 204*b* including intermediate layer bottom surface 202*b*, and a spacer layer 204*c* located between the top layer 204*a* and the bottom layer 204*b*. In an exemplary embodiment, the top layer 204*a* and the bottom layer 204*b* include an approximately 100% spun polyester fiber, and the spacer layer 204*c* includes an approximately 100% monofilament polyester fiber. In an exemplary embodiment, the intermediate layer 200 includes a spacer fabric including two outer textile substrates joined together and also separated by an insert of spacer yarns, which creates a ventilated layer of air between the substrates that allows the circulation of air while allowing heat and moisture to escape.

Figure 3:
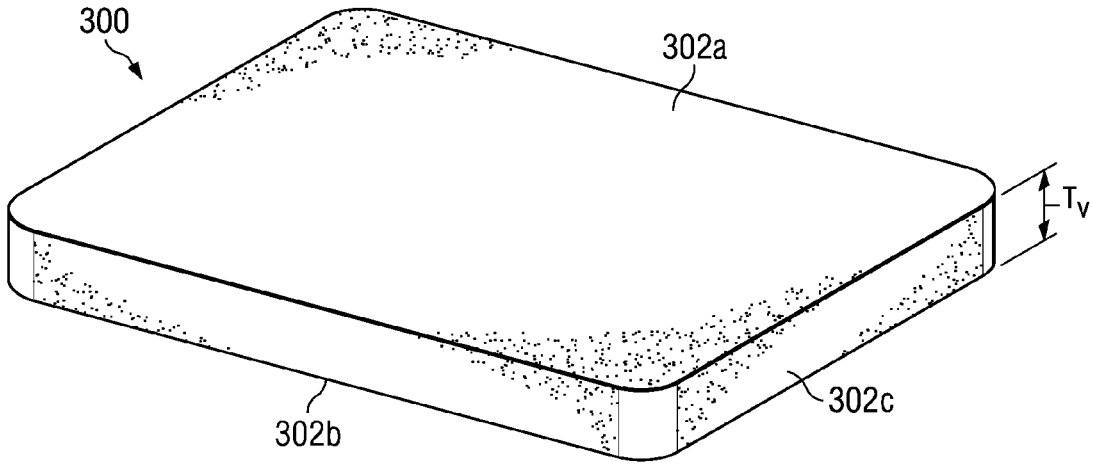
FIG. 3 is a perspective view illustrating an exemplary embodiment of a layer of visco elastic foam used with the layer of urethane foam of FIG. 1 and the intermediate layer of FIG. 2.

Referring now to FIG. 3, a layer of visco elastic foam 300 is illustrated. Visco elastic foam 300 includes a substantially planar visco elastic foam top surface 302*a*, a visco elastic foam bottom surface 302*b* located opposite the visco elastic foam top surface 302*a*, and a visco elastic foam side surface 302*c* extending between the visco elastic foam top surface 302*a* and the visco elastic foam bottom surface 302*b* and about the perimeter of the visco elastic foam 300. Visco elastic foam 300 has a thickness $T_V$ which is measured between the visco elastic foam top surface 302*a* and the visco elastic foam bottom surface 302*b*. In an exemplary embodiment, the thickness $T_V$ of the visco elastic foam 300 is approximately 3.5 inches. In an exemplary embodiment, the visco elastic foam 300 has a density of approximately 5 lbs/ft$^3$. In an exemplary embodiment, the visco elastic foam 300 has a compression range of approximately 10 to 15 pounds.

Figure 4:
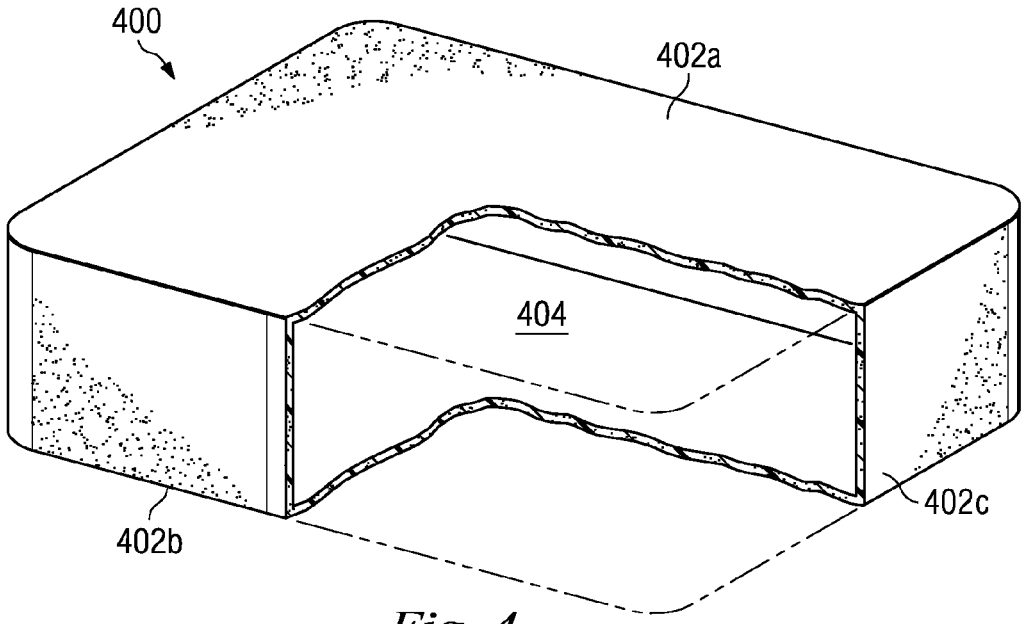
FIG. 4 is cut away perspective view illustrating an exemplary embodiment of a covering layer used with the layer of urethane foam of FIG. 1, the intermediate layer of FIG. 2, and the layer of visco elastic foam of FIG. 3.

Referring now to FIG. 4, a covering layer 400 is illustrated. Covering layer 400 includes a covering layer top section 402*a*, a covering layer bottom section 402*b*, and a covering layer side section 402*c* which extends between and couples together the covering layer top section 402*a* and the covering layer bottom section 402*b*. A covering layer cavity 404 is defined by the covering layer 400 and located between the covering layer top section 402*a*, the covering layer bottom section 402*b*, and the covering layer side section 402*c*. In an exemplary embodiment, the covering layer 400 includes a stretchable material which allows the covering member top section 402*a*, the covering member bottom section 402*b*, and the covering member side section 402*c* to increase in size, thereby increasing the size of covering member cavity 404. In an exemplary embodiment, the covering layer 400 includes a non-waterproof material.

Figure 5:
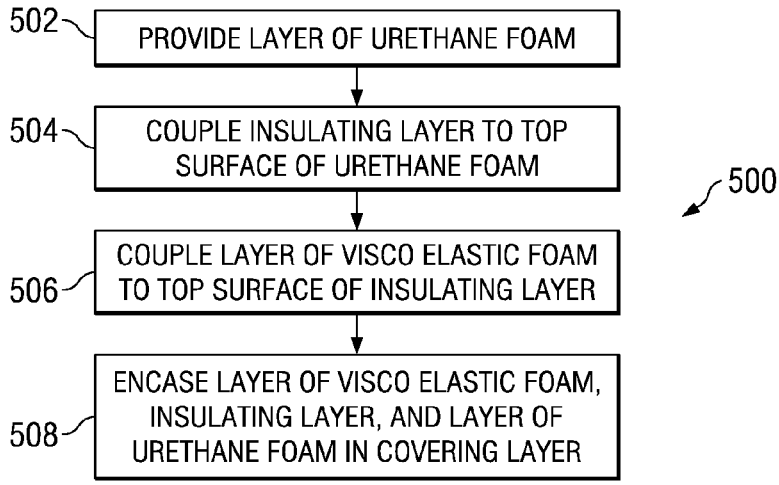
FIG. 5 is a flow chart illustrating an exemplary embodiment of method for manufacturing a mattress.

Referring now to FIGS. 1, 2, and 5, a method for manufacturing a mattress 500 is illustrated. Method 500 begins at step 502 where the layer of urethane foam 100 is provided. The method then proceeds to step 504 where the intermediate layer bottom surface 202*b* of intermediate layer 200 is coupled to the urethane foam top surface 102*a* on urethane foam 100. In an exemplary embodiment, the intermediate layer 200 is coupled to the urethane foam 100 using conventional methods known in the art.

Figure 5A:
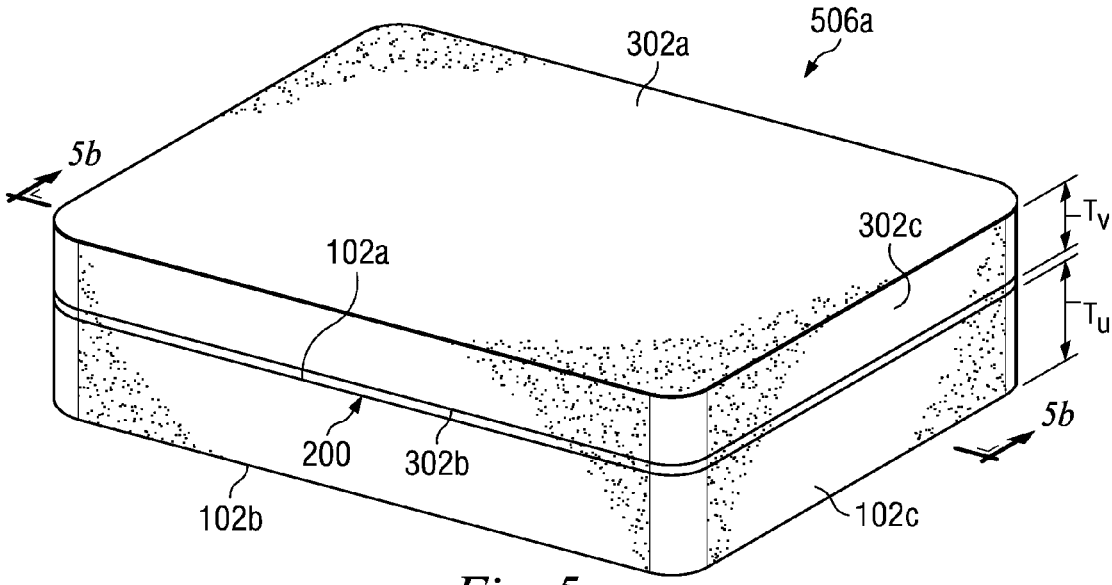
FIG. 5*a* is a perspective view illustrating an exemplary embodiment of the coupling of the layer of urethane foam of FIG. 1, the intermediate layer of FIG. 2, and the layer of visco elastic foam of FIG. 3 during the method of FIG. 5.
Figure 5B:
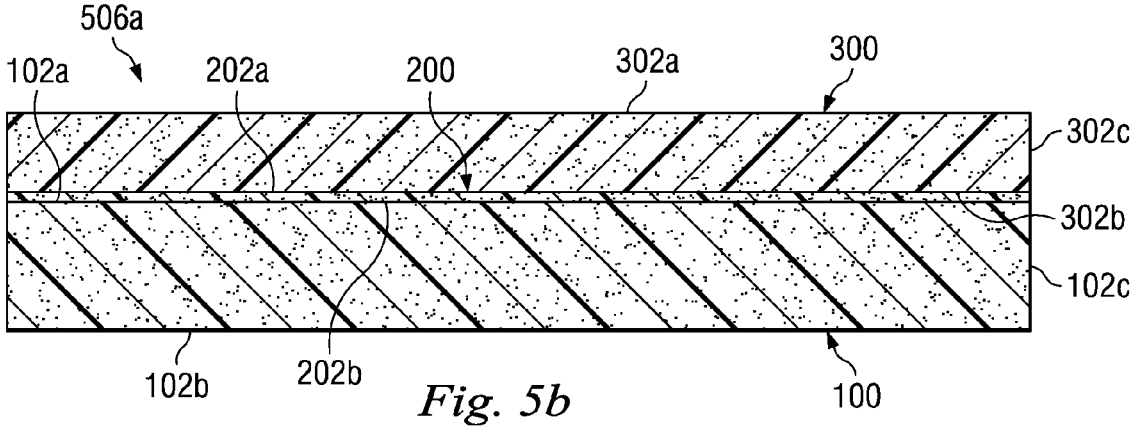
FIG. 5*b* is a cross sectional view illustrating an exemplary embodiment of the layer of urethane foam, the intermediate layer, and the layer of visco elastic foam of FIG. 5*a*.
Figure 5C:
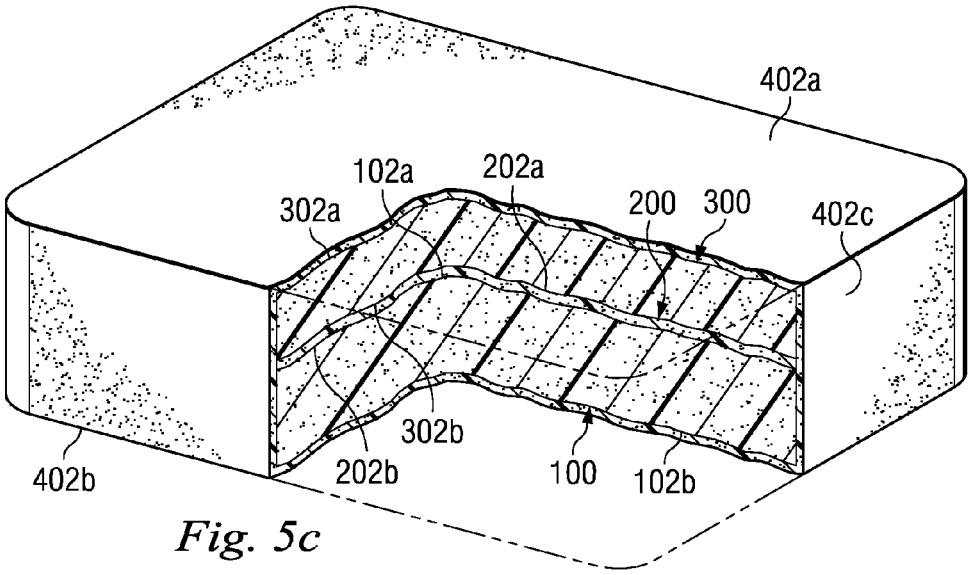
FIG. 5*c* is a cut away perspective view illustrating an exemplary embodiment of the layer of urethane foam, the intermediate layer, and the layer of visco elastic foam of FIG. 5*a* encased in the covering layer of FIG. 4 during the method of FIG. 5.

Referring now to FIGS. 5, 5*a*, and 5*b*, the method 500 proceeds to step 506 where the visco elastic foam bottom surface 302*b* of visco elastic foam 300 is coupled to the intermediate layer top surface 202*a* of intermediate layer 200. In an exemplary embodiment, the visco elastic foam 300 is coupled to the intermediate layer 200 using conventional methods known in the art. In an exemplary embodiment, the coupling of the urethane foam 100, the intermediate layer 200, and the visco elastic foam 300 provides a mattress 506*a*. In an exemplary embodiment, the coupling of the intermediate layer 200 between the urethane foam 100 and the visco elastic foam 300 provides an enhanced respiration in the mattress 506*a* due to the intermediate layer 200 allowing airflow through the mattress 506*a*. In an exemplary embodiment, the coupling of the intermediate layer 200 between the urethane foam 100 and the visco elastic foam 300 provides an enhanced humidity transport capacity in the mattress 506*a* due to the intermediate layer 200 allowing heat and moisture to escape from the mattress 506*a*, which may be generated, for example, on the visco elastic foam 300. In an exemplary embodiment, the mattress 506*a* includes the layer of urethane foam 100 having a thickness $T_U$ of approximately 4.5 inches, a density of approximately 1.65 lbs/ft$^3$, and a compression range of approximately 30 to 35 pounds, the layer of visco elastic foam 300 having a thickness $T_V$ of approximately 3.5 inches, a density of approximately 5 lbs/ft$^3$, and a compression range of approximately 10 to 15 pounds, and the intermediate layer 200 including either an approximately 1.1 ounce low melt polyester fiber or top layer 204*a* and bottom layer 204*b* with an approximately 100% spun polyester fiber and spacer layer 204*c* with an approximately 100% monofilament polyester fiber.

Referring now to FIGS. 4, 5, 5*a*, and 5*c*, the method 500 proceeds to step 508 where the mattress 506*a* including visco elastic foam 300, intermediate layer 200, and urethane foam 100 is encased in covering layer 400. Mattress 506*a* is positioned in covering layer cavity 404 such that covering layer top section 402*a* engages visco elastic foam top surface 102*a*, covering layer bottom section 402*b* engages urethane foam bottom surface 302*b*, and covering layer side section 402*c* engages visco elastic foam side section 302*c* and urethane foam side section 102*c*. In an exemplary embodiment, the covering layer 400 is operable to stretch around the mattress 506*a* in order to provide engagement between the covering layer 400 and the mattress 506*a*. In an exemplary embodiment, the covering layer 400 includes a loosely knitted mesh material that is porous to both humidity as well as air and heat, which provides very little additional restriction to airflow and allows venting of humidity and heat, providing a breathable area around the perimeter of the mattress 506*a*.

Figure 6:
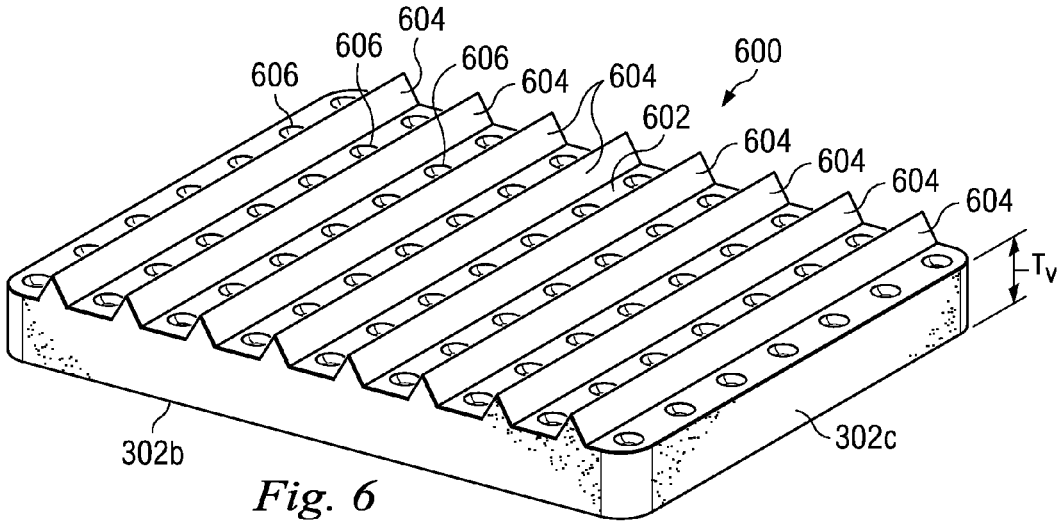
FIG. 6 is a perspective view illustrating an exemplary embodiment of layer of visco elastic foam.

Referring now to FIG. 6, an alternative embodiment of a layer of visco elastic foam 600 is substantially similar in design and operation to the layer of visco elastic foam 300 described above with reference to FIG. 3, with the provision of a non-planar visco elastic foam top surface 602. Visco elastic foam top surface 602 includes a plurality of surface members 604 extending from the visco elastic foam top surface 602 in a substantially parallel and spaced apart relationship from each other, and defines a plurality of recesses 606 in the visco elastic foam top surface 602 extending into the visco elastic foam 600 in a spaced apart relationship from each other and positioned in between the plurality of surface members 604. In an exemplary embodiment, the non-planar visco elastic foam top surface 602 provides ventilation of the layer of visco elastic foam 600 by allowing much quicker ventilation of moisture and heat by allowing a much lower resistance to air flow relative to a solid core of visco elastic foam, providing enhanced breathability. In an exemplary embodiment, non-planar visco elastic foam top surface 602 is operable to provide pressure point relief while enhancing air flow and heat release. In an exemplary embodiment, the plurality of recesses 606 may extend through the visco elastic foam 600. In an exemplary embodiment, the non-planar visco elastic foam top surface 602 may include a variety of different surface configurations.

Figure 7:
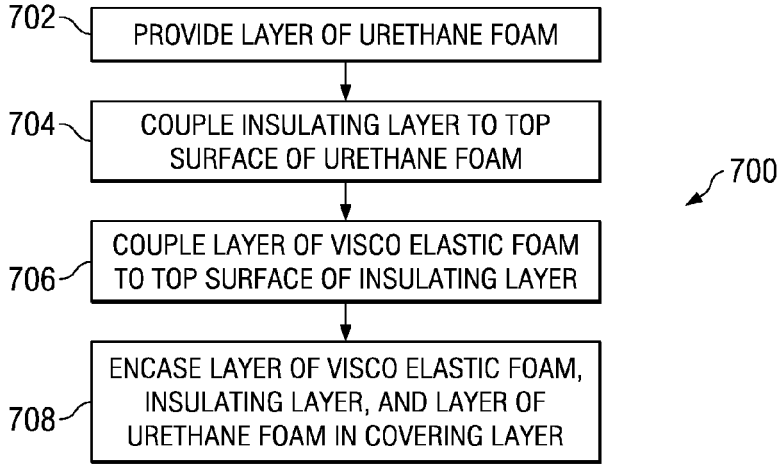
FIG. 7 is a flow chart illustrating an exemplary embodiment of a method for manufacturing a mattress.

Referring now to FIGS. 1, 2, and 7, a method for manufacturing a mattress 700 is illustrated which is substantially similar to the method for manufacturing a mattress 500, described above with reference to FIGS. 5, 5*a*, 5*b*, and 5*c*, with the provision of the layer of visco elastic foam 600 replacing the layer of visco elastic foam 300. Method 700 begins at step 702 where the layer of urethane foam 100 is provided. The method then proceeds to step 704 where the intermediate layer bottom surface 202*b* of intermediate layer 200 is coupled to the urethane foam top surface 102*a* on urethane foam 100. In an exemplary embodiment, the intermediate layer 200 is coupled to the urethane foam 100 using conventional methods known in the art.

Figure 7A:
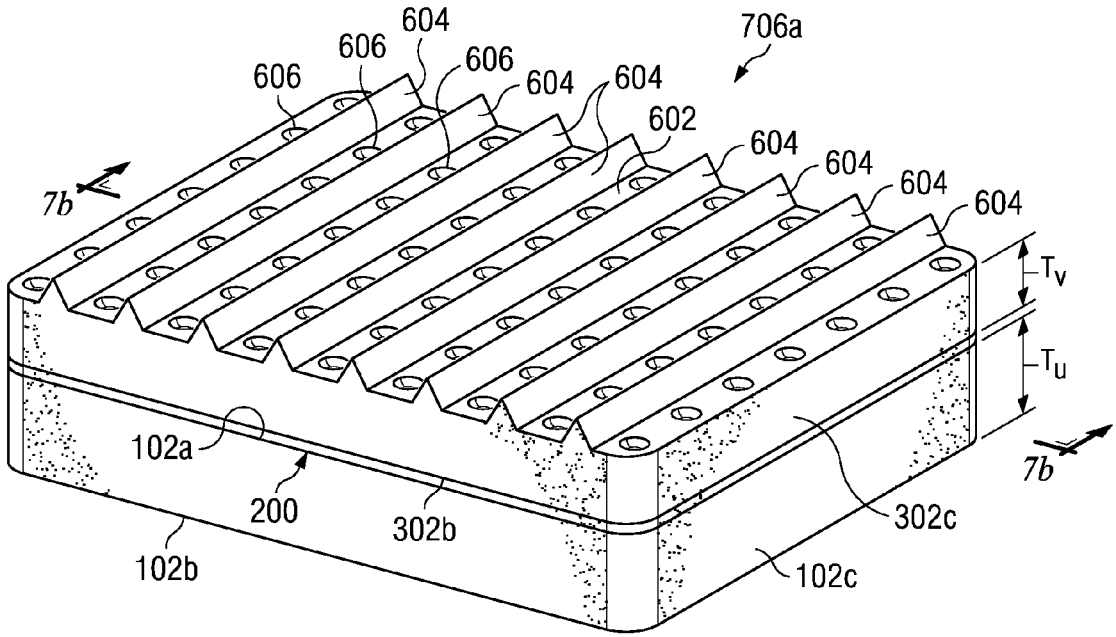
FIG. 7*a* is a perspective view illustrating an exemplary embodiment of the coupling of the layer of urethane foam of FIG. 1, the intermediate layer of FIG. 2, and the layer of visco elastic foam of FIG. 6 during the method of FIG. 7.
Figure 7B:
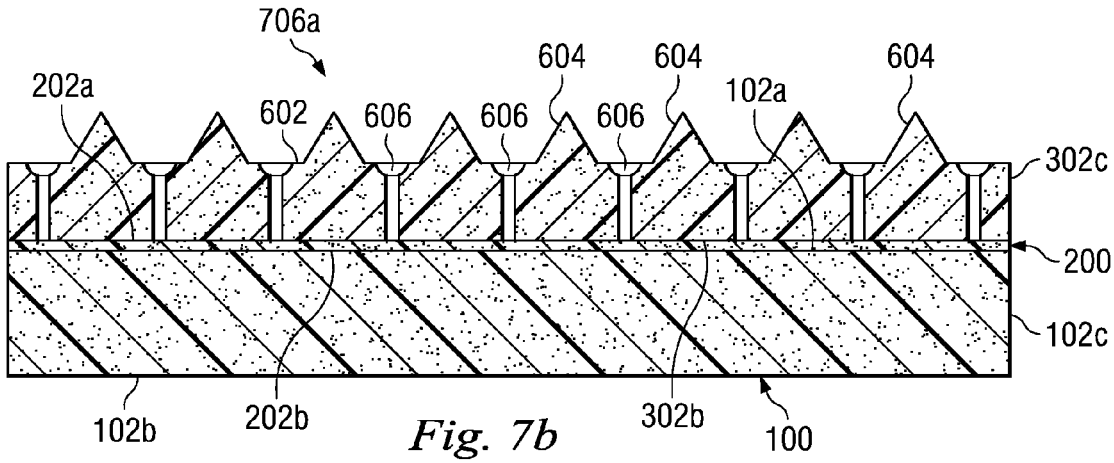
FIG. 7*b* is a cross sectional view illustrating an exemplary embodiment of the layer of urethane foam, the intermediate layer, and the layer of visco elastic foam of FIG. 7*a*.
Figure 7C:
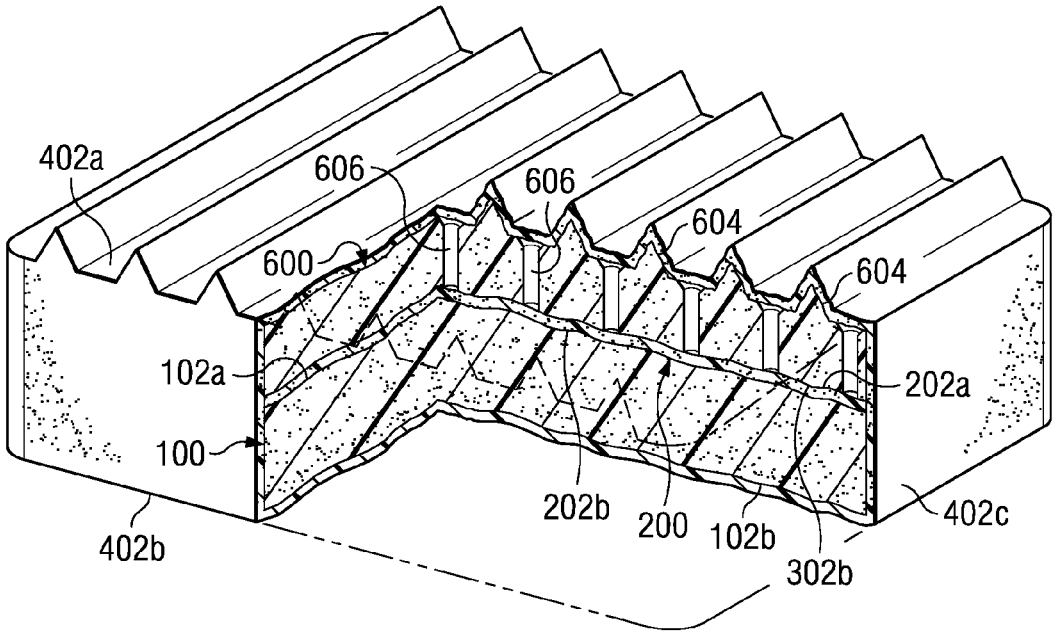
FIG. 7*c* is a cut away perspective view illustrating an exemplary embodiment of the layer of urethane foam, the intermediate layer, and the layer of visco elastic foam of FIG. 7*a* encased in the covering layer of FIG. 4 during the method of FIG. 7.

Referring now to FIGS. 7, 7*a*, and 7*b*, the method 700 proceeds to step 706 where the visco elastic foam bottom surface 302*b* of visco elastic foam 600 is coupled to the intermediate layer top surface 202*a* of intermediate layer 200. In an exemplary embodiment, the plurality of recesses 602 extend through the visco elastic foam 600 to the intermediate layer top surface 202*a*. In an exemplary embodiment, the visco elastic foam 600 is coupled to the intermediate layer 200 using conventional methods known in the art. In an exemplary embodiment, the coupling of the urethane foam 100, the intermediate layer 200, and the visco elastic foam 600 provides a mattress 706*a*. In an exemplary embodiment, the coupling of the intermediate layer 200 between the urethane foam 100 and the visco elastic foam 600 provides an enhanced respiration in the mattress 706*a* due to the intermediate layer 200 allowing airflow through the mattress 706*a*. In an exemplary embodiment, the coupling of the intermediate layer 200 between the urethane foam 100 and the visco elastic foam 600 provides an enhanced humidity transport capacity in the mattress 706*a* due to the intermediate layer 200 allowing heat and moisture to escape from the mattress 706*a*, which may be generated, for example, on the visco elastic foam 600. In an exemplary embodiment, the mattress 706*a* includes the layer of urethane foam 100 having a thickness $T_U$ of approximately 6 inches, a density of approximately 1.65 lbs/ft$^3$, and a compression range of approximately 30 to 35 pounds, the layer of visco elastic foam 300 having a thickness $T_V$ of approximately 4 inches, a density of approximately 5 lbs/ft$^3$, and a compression range of approximately 10 to 15 pounds, and the intermediate layer 200 including either an approximately 1.1 ounce low melt polyester fiber or top layer 204*a* and bottom layer 204*b* with an approximately 100% spun polyester fiber and spacer layer 204*c* with an approximately 100% monofilament polyester fiber.

Referring now to FIGS. 4, 7, 7*a*, and 7*c*, the method 700 proceeds to step 708 where the mattress 706*a* including visco elastic foam 600, intermediate layer 200, and urethane foam 100 is encased in covering layer 400. Mattress 706*a* is positioned in covering layer cavity 404 such that covering layer top section 402*a* engages visco elastic foam top surface 602, covering layer bottom section 402*b* engages urethane foam bottom surface 302*b*, and covering layer side section 402*c* engages visco elastic foam side section 302*c* and urethane foam side section 102*c*. In an exemplary embodiment, the covering layer 400 is operable to stretch around the mattress 706*a* in order to provide engagement between the covering layer 400 and the mattress 706*a*. In an exemplary embodiment the covering layer 400 includes a loosely knitted mesh material that is porous to both humidity as well as air and heat, which provides very little additional restriction to airflow and allows venting of humidity and heat, providing a breathable area around the perimeter of the mattress 706*a*.

Figure 8:
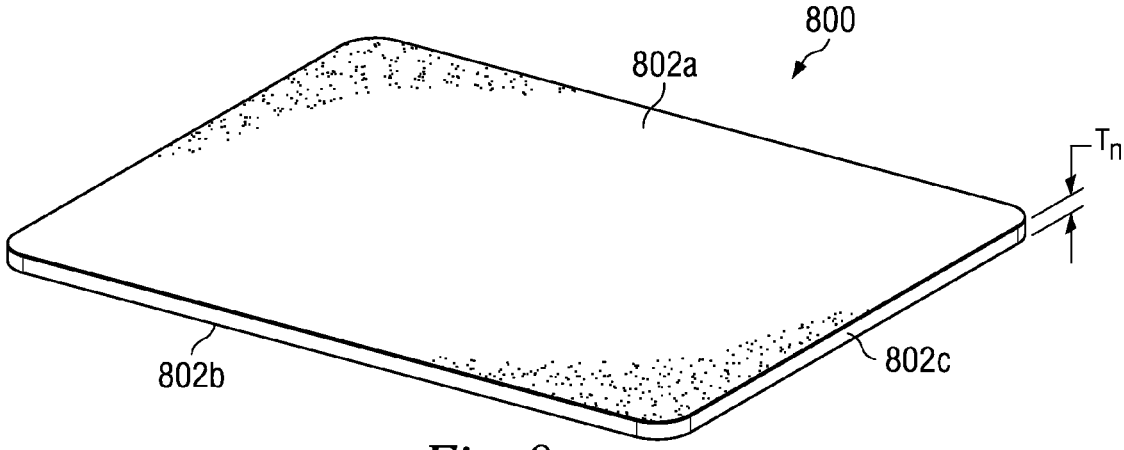
FIG. 8 is a perspective view illustrating a exemplary embodiment of a layer of natural foam.

Referring now to FIG. 8, a layer of natural foam 800 is illustrated. Natural foam 800 includes a substantially planar natural foam top surface 802*a*, a natural foam bottom surface 802*b* located opposite the natural foam top surface 802*a*, and a natural foam side surface 802*c* extending between the natural foam top surface 802*a* and the natural foam bottom surface 802*b* and about the perimeter of the natural foam 800. Natural foam 800 has a thickness $T_N$ which is measured between the natural foam top surface 802*a* and the natural foam bottom surface 802*b*. In an exemplary embodiment, the natural foam 800 includes a talalay latex natural foam. In an exemplary embodiment, the thickness $T_N$ of the natural foam 800 is approximately 1 inch. In an exemplary embodiment, the natural foam 800 has a density of approximately 2.5 lbs/ft$^3$.

Figure 9:
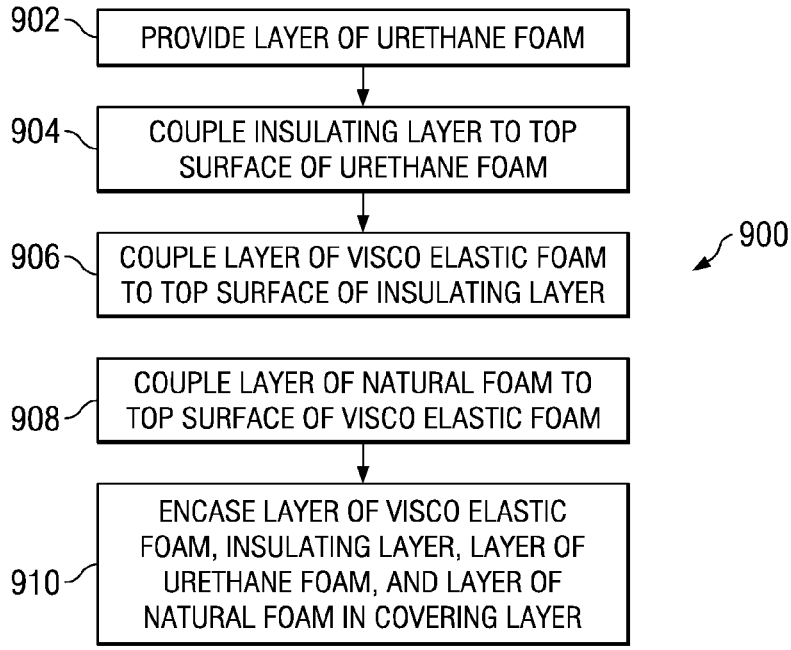
FIG. 9 is a flow chart illustrating an exemplary embodiment of a method for manufacturing a mattress.

Referring now to FIGS. 1, 2, and 9, a method for manufacturing a mattress 900 is illustrated which is substantially similar to the method for manufacturing a mattress 700, described above with reference to FIGS. 7, 7*a*, 7*b*, and 7*c*, with the provision of the layer of natural foam 800. Method 900 begins at step 902 where the layer of urethane foam 100 is provided. The method then proceeds to step 904 where the intermediate layer bottom surface 202*b* of intermediate layer 200 is coupled to the urethane foam top surface 102*a* on urethane foam 100. In an exemplary embodiment, the intermediate layer 200 is coupled to the urethane foam 100 using conventional methods known in the art.

Figure 9A:
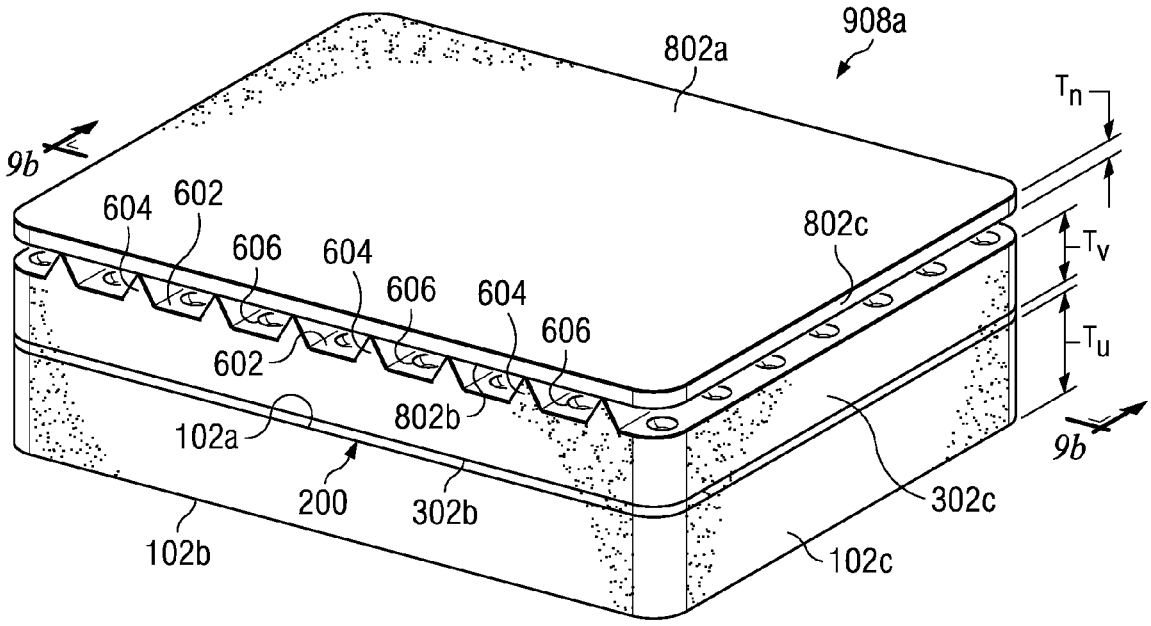
FIG. 9*a* is a perspective view illustrating an exemplary embodiment of the coupling of the layer of urethane foam of FIG. 1, the intermediate layer of FIG. 2, the layer of visco elastic foam of FIG. 6, and the layer of natural foam of FIG. 8 during the method of FIG. 9.
Figure 9B:
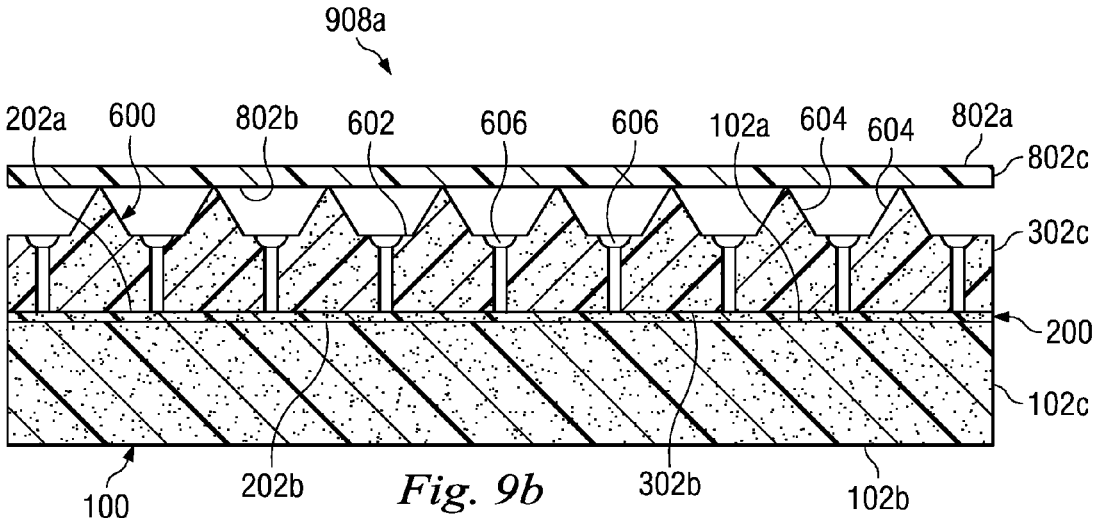
FIG. 9*b* is a cross sectional view illustrating an exemplary embodiment of the layer of urethane foam, the intermediate layer, the layer of visco elastic foam, and the layer of natural foam of FIG. 9*a*.
Figure 9C:
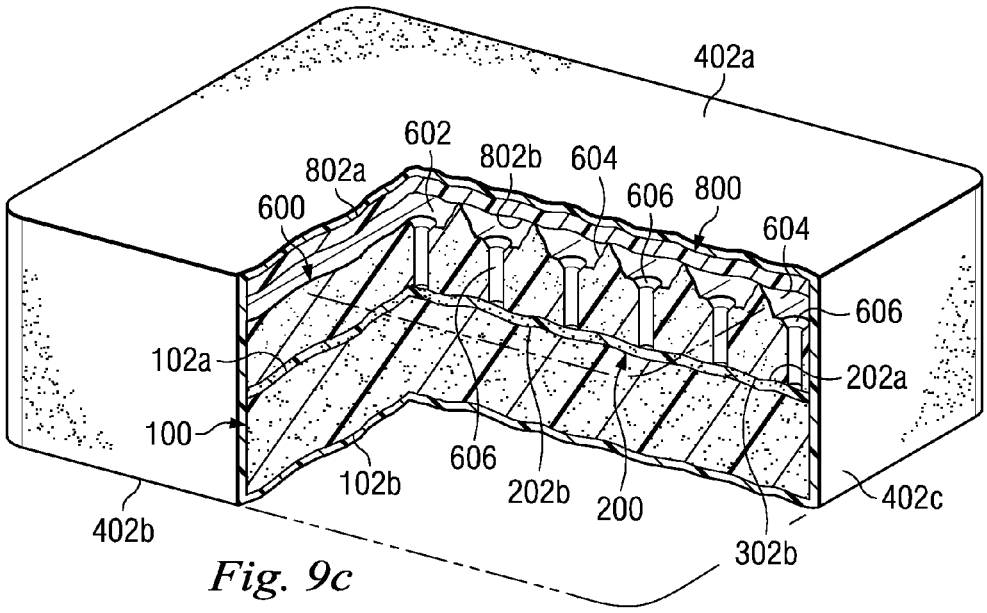
FIG. 9*c* is a cut away perspective view illustrating an exemplary embodiment of the layer of urethane foam, the intermediate layer, the layer of visco elastic foam, and the layer of natural foam of FIG. 9*a* encased in the covering layer of FIG. 4 during the method of FIG. 9.

Referring now to FIGS. 9, 9*a*, and 9*b*, the method 900 proceeds to step 906 where the visco elastic foam bottom surface 302*b* of visco elastic foam 600 is coupled to the intermediate layer top surface 202*a* of intermediate layer 200. The method 900 then proceeds to step 908 where the natural foam 800 is coupled to the surface members 604 on visco elastic foam top surface 602 of visco elastic foam 600. In an exemplary embodiment, the visco elastic foam 600 is coupled to the intermediate layer 200 using conventional methods known in the art. In an exemplary embodiment, the natural foam 800 is coupled to the surface members 604 on visco elastic foam top surface 602 of visco elastic foam 600 using conventional methods known in the art. In an exemplary embodiment, the coupling of the urethane foam 100, the intermediate layer 200, the visco elastic foam 600, and the natural foam 800 provides a mattress 908*a*. In an exemplary embodiment, the coupling of the intermediate layer 200 between the urethane foam 100 and the visco elastic foam 600 provides an enhanced respiration in the mattress 908*a* due to the intermediate layer 200 allowing airflow through the mattress 908*a*. In an exemplary embodiment, the coupling of the intermediate layer 200 between the urethane foam 100 and the visco elastic foam 600 provides an enhanced humidity transport capacity in the mattress 908*a* due to the intermediate layer 200 allowing heat and moisture to escape from the mattress 908*a*, which may be generated, for example, on the natural foam 800 and/or the viscoelastic foam 600. In an exemplary embodiment, the mattress 908*a* includes the layer of urethane foam 100 having a thickness $T_U$ of approximately 6 inches, a density of approximately 1.65 lbs/ft$^3$, and a compression range of approximately 30 to 35 pounds, the layer of visco elastic foam 300 having a thickness $T_V$ of approximately 4 inches, a density of approximately 5 lbs/ft$^3$, and a compression range of approximately 10 to 15 pounds, the layer of natural foam 800 having a thickness $T_N$ of approximately 1 inch and a density of approximately 2.5 lbs/ft$^3$, and the intermediate layer 200 including either an approximately 1.1 ounce low melt polyester fiber or top layer 204*a* and bottom layer 204*b* with an approximately 100% spun polyester fiber and spacer layer 204*c* with an approximately 100% monofilament polyester fiber.

Referring now to FIGS. 4, 9, 9*a*, and 9*c*, the method 900 proceeds to step 910 where the mattress 908*a* including visco elastic foam 600, intermediate layer 200, urethane foam 100, and natural foam 800 is encased in covering layer 400. Mattress 908*a* is positioned in covering layer cavity 404 such that covering layer top section 402*a* engages natural foam top surface 802*a*, covering layer bottom section 402*b* engages urethane foam bottom surface 302*b*, and covering layer side section 402*c* engages natural foam side section 802*c*, visco elastic foam side section 302*c*, and urethane foam side section 102*c*. In an exemplary embodiment, the covering layer 400 is operable to stretch around the mattress 908*a* in order to provide engagement between the covering layer 400 and the mattress 908*a*. In an exemplary embodiment, the covering layer 400 includes a loosely knitted mesh material that is porous to both humidity as well as air and heat, which provides very little additional restriction to airflow and allows venting of humidity and heat, providing a breathable area around the perimeter of the mattress 908*a*.

A mattress has been described that includes a layer of urethane foam, a layer of visco elastic foam, and an intermediate layer for enhancing humidity transport positioned between the layer of urethane foam and the layer of visco elastic foam. In an exemplary embodiment, the layer of visco elastic foam is positioned above the layer of urethane foam. In an exemplary embodiment, the layer of visco elastic foam comprises a substantially planar top surface. In an exemplary embodiment, the layer of visco elastic foam comprises a non-planer top surface. In an exemplary embodiment, the layer of visco elastic foam is ventilated. In an exemplary embodiment, the non-planer top surface on the visco elastic foam is operable to provide pressure point relief while enhancing air flow and heat release. In an exemplary embodiment, the layer of visco elastic foam comprises a thickness of approximately 3.5 inches. In an exemplary embodiment, the layer of visco elastic foam comprises a thickness of approximately 4 inches. In an exemplary embodiment, the layer of visco elastic foam comprises a density of approximately 5 lbs/ft$^3$. In an exemplary embodiment, the layer of visco elastic foam comprises a compression range of approximately 10 to 15 pounds. In an exemplary embodiment, the layer of urethane foam comprises a thickness of approximately 4.5 inches. In an exemplary embodiment, the layer of urethane foam comprises a thickness of approximately 6 inches. In an exemplary embodiment, the layer of urethane foam comprises a density of approximately 1.65 lbs/ft$^3$. In an exemplary embodiment, the layer of urethane foam comprises a compression range of approximately 30 to 35 pounds. In an exemplary embodiment, the intermediate layer comprises a polyester fiber intermediate layer. In an exemplary embodiment, the intermediate layer is operable to enhance the respiration of the mattress. In an exemplary embodiment, the intermediate layer is operable to enhance the humidity transport capacity of the mattress. In an exemplary embodiment, the intermediate layer comprises a low melt polyester fiber. In an exemplary embodiment, the intermediate layer comprises a layer of approximately 1.1 ounce low melt polyester fiber. In an exemplary embodiment, the intermediate layer comprises a spun polyester fiber. In an exemplary embodiment, the intermediate layer comprises a monofilament polyester fiber spacer. In an exemplary embodiment, the intermediate layer comprises a spun polyester fiber on a top surface and a bottom surface of the intermediate layer and a monofilament polyester fiber spacer located between the top surface and the bottom surface. In an exemplary embodiment, the intermediate layer comprises an approximately 100% spun polyester fiber on a top surface and a bottom surface of the intermediate layer and an approximately 100% monofilament polyester fiber spacer located between the top surface and the bottom surface. In an exemplary embodiment, the mattress further includes a covering layer encasing the layer of urethane foam, the layer of visco elastic foam, and the intermediate layer. In an exemplary embodiment, the covering layer is operable to provide a breathable area around the perimeter of the mattress. In an exemplary embodiment, the covering layer includes a non-waterproof material. In an exemplary embodiment, the mattress further includes a layer of natural foam positioned on top of the layer of visco elastic foam, the layer of urethane foam, and the intermediate layer. In an exemplary embodiment, the layer of natural foam comprises a thickness of approximately 1 inch. In an exemplary embodiment, the layer of natural foam comprises a density of approximately 2.5 lbs/ft$^3$. In an exemplary embodiment, the layer of natural foam comprises talalay latex natural foam. In an exemplary embodiment, the mattress further includes a covering layer encasing the layer of urethane foam, the layer of visco elastic foam, the intermediate layer, and the layer of nature foam. In an exemplary embodiment, the covering layer is operable to provide a breathable area around the perimeter of the mattress. In an exemplary embodiment, the covering layer includes a non-waterproof material.

A method for manufacturing a mattress has been described that includes providing a layer of urethane foam having a urethane foam top surface, coupling an intermediate layer for enhancing humidity transport to the urethane foam top surface the intermediate layer including an intermediate layer top surface, and coupling a layer of visco elastic foam including a visco elastic foam top surface to the intermediate layer top surface. In an exemplary embodiment, the method further includes encasing the layer of visco elastic foam, the intermediate layer, and the layer of urethane foam in a covering layer. In an exemplary embodiment, the method further includes enhancing the respiration of the mattress with the intermediate layer. In an exemplary embodiment, the method further includes enhancing the humidity transport capacity of the mattress of the intermediate layer. In an exemplary embodiment, the method further includes coupling a layer of natural foam to the visco elastic foam top surface. In an exemplary embodiment, the method further includes encasing the layer of natural foam, the layer of visco elastic foam, the intermediate layer, and the layer of urethane foam in a covering layer.

A mattress has been described that includes a top layer of visco elastic foam comprising a substantially planar top surface, a thickness of approximately 3.5 inches, and a density of approximately 5 lbs/ft$^3$, a bottom layer of urethane foam comprising a thickness of approximately 4.5 inches and a density of approximately 1.65 lbs/ft$^3$, and a polyester fiber intermediate layer positioned between the top layer of visco elastic foam and the bottom layer of urethane foam. In an exemplary embodiment, the polyester fiber intermediate layer comprises an approximately 1.1 ounce low melt polyester fiber. In an exemplary embodiment, the polyester fiber intermediate layer comprises an approximately 100% spun polyester fiber on a top surface and a bottom surface of the intermediate layer and an approximately 100% monofilament polyester fiber spacer located between the top surface and the bottom surface of the intermediate layer. In an exemplary embodiment, the mattress further includes a non-waterproof covering layer encasing the top layer of visco elastic foam, the bottom layer of urethane foam, and the polyester fiber intermediate layer.

A mattress has been described that includes a top layer of visco elastic foam comprising a ventilated non-planar top surface, a thickness of approximately 4 inches, and a density of approximately 5 lbs/ft$^3$, a bottom layer of urethane foam comprising a thickness of approximately 6 inches and a density of approximately 1.65 lbs/ft$^3$, and a polyester fiber intermediate layer positioned between the top layer of visco elastic foam and the bottom layer of urethane foam. In an exemplary embodiment, the polyester fiber intermediate layer comprises an approximately 1.1 ounce low melt polyester fiber. In an exemplary embodiment, the polyester fiber intermediate layer comprises an approximately 100% spun polyester fiber on a top surface and a bottom surface of the intermediate layer, and an approximately 100% monofilament polyester fiber spacer located between the top surface and the bottom surface of the intermediate layer. In an exemplary embodiment, the mattress further includes a non-waterproof covering layer encasing the top layer of visco elastic foam, the bottom layer of urethane foam, and the polyester fiber intermediate layer.

A mattress has been described that includes a top layer of talalay latex natural foam comprising a thickness of approximately 1 inch and a density of approximately 2.5 lbs/ft$^3$, an intermediate layer of visco elastic foam comprising a ventilated non-planar top surface, a thickness of approximately 4 inches, and a density of approximately 5 lbs/ft$^3$, a bottom layer of urethane foam comprising a thickness of approximately 6 inches and a density of approximately 1.65 lbs/ft$^3$, and a polyester fiber intermediate layer positioned between the top layer of visco elastic foam and the bottom layer of urethane foam. In an exemplary embodiment, the polyester fiber intermediate layer comprises an approximately 1.1 ounce low melt polyester fiber. In an exemplary embodiment, the polyester fiber intermediate layer comprises an approximately 100% spun polyester fiber on a top surface and a bottom surface of the intermediate layer, and an approximately 100% monofilament polyester fiber spacer located between the top surface and the bottom surface of the intermediate layer. In an exemplary embodiment, the mattress further includes a non-waterproof covering layer encasing the top layer of talalay latex natural foam, the intermediate layer of visco elastic foam, the bottom layer of urethane foam, and the intermediate polyester fiber layer.

A mattress has been described that includes a layer of urethane foam, a layer of visco elastic foam, and means for enhancing the respiration and humidity transport capacity of the mattress positioned between the layer of urethane foam and the layer of visco elastic foam. In an exemplary embodiment, the mattress further includes means for encasing the layer of urethane foam, the layer of visco elastic foam, and the means for enhancing the respiration and humidity transport capacity of the mattress.

It is understood that variations may be made in the foregoing without departing from the scope of the disclosed embodiments. Furthermore, the elements and teachings of the various illustrative embodiments may be combined in whole or in part some or all of the illustrated embodiments.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A mattress comprising:

a top layer of visco elastic foam comprising a substantially planar top surface, a thickness of approximately 3.5 inches, and a density of approximately 5 lbs/ft$^3$;

a bottom layer of urethane foam comprising a thickness of approximately 4.5 inches and a density of approximately 1.65 lbs/ft$^3$; and a polyester fiber intermediate layer positioned between the top layer of visco elastic foam and the bottom layer of urethane foam.

2. The mattress of claim 1 wherein the polyester fiber intermediate layer comprises an approximately 1.1 ounce low melt polyester fiber.

3. The mattress of claim 1 where the polyester fiber intermediate layer comprises an approximately 100% spun polyester fiber on a top surface and a bottom surface of the intermediate layer and an approximately 100% monofilament polyester fiber spacer located between the top surface and the bottom surface of the intermediate layer.

4. The mattress of claim 1 further comprising:

a non-waterproof covering layer encasing the top layer of visco elastic foam, the bottom layer of urethane foam, and the polyester fiber intermediate layer.

5. A mattress comprising:

a top layer of visco elastic foam comprising a ventilated non-planar top surface, a thickness of approximately 4 inches, and a density of approximately 5 lbs/ft$^3$;

a bottom layer of urethane foam comprising a thickness of approximately 6 inches and a density of approximately 1.65 lbs/ft$^3$; and a polyester fiber intermediate layer positioned between the intermediate layer of visco elastic foam and the bottom layer of urethane foam.

6. The mattress of claim 5 wherein the polyester fiber intermediate layer comprises an approximately 1.1 ounce low melt polyester fiber.

7. The mattress of claim 5 where the polyester fiber intermediate layer comprises an approximately 100% spun polyester fiber on a top surface and a bottom surface of the intermediate layer, and an approximately 100% monofilament polyester fiber spacer located between the top surface and the bottom surface of the intermediate layer.

8. The mattress of claim 5 further comprising:

a non-waterproof covering layer encasing the top layer of visco elastic foam, the bottom layer of urethane foam, and the polyester fiber intermediate layer.

9. A mattress comprising:

a top layer of talalay latex natural foam comprising a thickness of approximately 1 inch and a density of approximately 2.5 lbs/ft$^3$;

an intermediate layer of visco elastic foam comprising a ventilated nonplanar top surface, a thickness of approximately 4 inches, and a density of approximately 5 lbs/ft$^3$;

a bottom layer of urethane foam comprising a thickness of approximately 6 inches and a density of approximately 1.65 lbs/ft$^3$; and a polyester fiber intermediate layer positioned between the top layer of visco elastic foam and the bottom layer of urethane foam.

10. The mattress of claim 9 wherein the polyester fiber intermediate layer comprises an approximately 1.1 ounce low melt polyester fiber.

11. The mattress of claim 9 where the polyester fiber intermediate layer comprises an approximately 100% spun polyester fiber on a top surface and a bottom surface of the intermediate layer, and an approximately 100% monofilament polyester fiber spacer located between the top surface and the bottom surface of the intermediate layer.

12. The mattress of claim 9 further comprising:

a non-waterproof covering layer encasing the top layer of talalay latex natural foam, the intermediate layer of visco elastic foam, the bottom layer of urethane foam, and the intermediate polyester fiber layer.

13. A mattress comprising:

a layer of urethane foam;

a layer of visco elastic foam; and an intermediate layer for enhancing humidity transport positioned between the layer of urethane foam and the layer of visco elastic foam; the intermediate layer comprising polyester fiber.

14. The mattress of claim 13 wherein said polyester fiber comprises a low melt polyester fiber.

15. The mattress of claim 13 wherein the polyester fiber comprises 1.1 ounce low melt polyester fiber.

16. The mattress of claim 13 wherein the polyester fiber comprises spun polyester fiber.

17. The mattress of claim 13 wherein the intermediate layer comprises a monofilament polyester fiber spacer.

18. The mattress of claim 13 wherein the intermediate layer comprises a spun polyester fiber top surface and bottom surface and a monofilament polyester fiber spacer located between the top and bottom surface.

19. The mattress of claim 18 wherein the intermediate layer comprises a top and bottom surface, both comprising about 100% spun polyester fiber, and a spacer located between said top and bottom layer, said spacer comprising about 100% monofilament polyester fiber.

20. A mattress comprising:

a layer of urethane foam;

a layer of visco elastic foam;

an intermediate layer for enhancing humidity transport positioned between the layer of urethane foam and the layer of visco elastic foam; and a layer of natural foam positioned on top of the layer of visco elastic foam, the layer of urethane foam, and the intermediate layer.

21. The mattress of claim 20 wherein the layer of natural foam comprises a thickness of about 1 inch.

22. The mattress of claim 20 wherein the layer of natural foam comprises density of about 2.5 lbs/ft$^3$.

23. The mattress of claim 20 wherein the layer of natural foam comprises talalay latex natural foam.

24. The mattress of claim 20 further comprising:

a covering layer encasing the layer of urethane foam, the layer of visco elastic foam, the intermediate layer and the layer of natural foam.

25. The mattress of claim 24 wherein the covering layer provides a breathable area around the perimeter of the mattress.

26. The mattress of claim 24 wherein the covering layer comprises a non-waterproof material.

27. A method for manufacturing a mattress comprising:

providing a layer of urethane foam having a urethane foam top surface;

coupling an intermediate layer for enhancing humidity transport to said urethane foam top surface, the intermediate layer having an intermediate layer top surface; coupling a layer of visco elastic foam to said intermediate layer top surface, said visco elastic foam having a visco elastic foam top surface; and coupling a layer of natural foam to the visco elastic foam top surface.

28. The method of claim 27 further comprising:

increasing the layer of natural foam, the layer of visco elastic foam, the intermediate layer and the layer of urethane foam with a covering layer.

* * * * *